United States Patent [19]

Moegen et al.

[11] 4,028,879

[45] June 14, 1977

[54] SWITCHING ARRANGEMENT FOR SETTING TIME-MEASURING APPARATUS

[75] Inventors: Gerhard Moegen, Neubaldham, Germany; Edward Y. Tang, Los Altos, Calif.

[73] Assignee: Eurosil G.m.b.H., Munich, Germany

[22] Filed: July 24, 1975

[21] Appl. No.: 598,849

[30] Foreign Application Priority Data

July 26, 1974 Germany ..... 2436129

[52] U.S. Cl. ..... 58/23 R; 58/85.5

[51] Int. Cl.² ..... G04C 3/00

[58] Field of Search ..... 58/23 R, 23 A, 23 AC, 58/33, 34, 57, 85.5

[56] References Cited

UNITED STATES PATENTS

| | | | |
|---|---|---|---|
| 3,672,155 | 6/1972 | Bergey et al. | 58/85.5 X |
| 3,678,680 | 7/1972 | Fujita | 58/23 R |
| 3,717,990 | 2/1973 | Fujita | 58/34 X |
| 3,733,810 | 5/1973 | Girard | 58/23 R X |
| 3,777,471 | 12/1973 | Koehler et al. | 58/23 R |
| 3,789,601 | 2/1974 | Bergey | 58/85.5 X |
| 3,810,356 | 5/1974 | Fujita | 58/23 R |
| 3,852,952 | 12/1974 | Vittoz et al. | 58/23 R |
| 3,871,168 | 3/1975 | Maire et al. | 58/23 R |
| 3,886,726 | 6/1975 | Williams et al. | 58/23 R X |
| 3,916,612 | 11/1975 | Morokawa et al. | 58/23 R |

*Primary Examiner*—Stanley J. Witkowski

*Attorney, Agent, or Firm*—Gregg, Hendricson, Caplan & Becker

[57] ABSTRACT

A switching arrangement and method for setting or adjusting a time-measuring device comprising at least two counters connected one after the other and connected in certain cases with indicator devices, of which one counter changes the counter position thereof by count-pulses emitted by a generator circuit at successive intervals of time and of which the other counter respectively upon transition of the said one counter from one defined counter position into another defined counter position receives a signal fed from the said one counter, which brings about its onward count, and a control device for resetting the said one counter, characterized in that the counting-range of the said one counter is divided up into two partial ranges of preferably at least approximately equal size, in one of which the said one counter emits a defined first output signal and in the other of which the one counter in question emits a defined second output signal, and that the control device resets the one counter in question out of a counter position lying in the first partial range into a first reset counter position lying in this first partial range for setting the time-measuring device backward and resetting of the said one counter out of a counter position lying in the second partial range into a second reset counter position likewise lying in the first partial range for setting the time measuring device forward.

14 Claims, 5 Drawing Figures

SWITCHING ARRANGEMENT FOR SETTING TIME-MEASURING APPARATUS

BACKGROUND OF THE INVENTION

The present invention relates to the field of switching arrangements for setting or adjusting a time-measuring device comprising at least two counters connected one after the other and also connected in certain cases to indicating devices, wherein a first counter changes its counter position by countpulses received from a generator circuit at successive intervals of time and wherein the second counter respectively upon transition of the first counter from one defined counter position into another defined counter position receives a signal from the first counter to cause an onward count thereof, and a control device resets the first counter.

In connection with the setting of a time-measuring device including counters connected one after the other for counting seconds, minutes and hours, respectively, and controlled by a crystal oscillator, it is known from German Pat. No. 2,302,978 to employ a mechanically actuable switch for turning back the counter employed for measurement of seconds. With this kind of adjustment of time-measuring devices, it is only possible to set the time-measuring device backward. In order to set the time-measuring device forward, e.g., by a few seconds, it is necessary to set the time-measuring device in question backward in the way described until the proper second indication is achieved. This operation is time consuming.

There has also been developed a time-setting mechanism for an electronic clock, as shown in German Pat. No. 2,025,710 in which the setting of the time is controllable by a single actuator part at two or more different speeds. In this system, however, it is only possible to set a time-measuring device forward. If it is desired to set a time-measuring device backward by a certain interval of time, it is necessary with this system to operate the mechanism at high speed, that is, up to a desired setting; hence, this procedure is also relatively time consuming and laborious.

Another prior art system disclosed in German Pat. No. 2,319,437 provides switching arrangements for correction of the individual indicators of separate clock functions. This known clock system contains a selector switch for the indication point to be indicated at the time or the like and a setting switch for repositioning the indication to the indication point selected at the time, so that combined actuation of the switches in question is necessary for correction. This kind of correction of the setting of a clock is also relatively laborious. This latter system also has the disadvantage of requiring complex switching circuitry of substantial expense.

A further system disclosed in U.S. Pat. No. 3,672,155 also provides means for resetting counters in an electronic wrist watch. In this case also, correction is only possible in one direction and substantial switching complexity is involved.

SUMMARY OF THE INVENTION

The present invention provides a simplified switching system wherein setting or respectively adjustment of the time-measuring device both in the direction of forward setting and backward setting is accomplished in particular by a number of steps corresponding with the smallest unit of time to be taken into consideration at any time.

The problems identified above are herein solved in the case of a switching arrangement of the kind mentioned above by dividing the counting range of a first counter into two partial ranges of preferably at least approximately equal size, in one of which the first counter emits a defined first output signal and in the other of which the first counter in question emits a defined second output signal. The control device provides for resetting of the first counter in question out of a counter position lying in this first partial range for setting the time-measuring device backward and resetting of the said first counter out of a counter position lying in the second partial range into a second reset counter position likewise lying in the first partial range for setting the time-measuring device forward.

The present invention has the advantage of very simply setting the measuring device forward or backward by resetting of the first counter into the first reset counter condition that the first counter emits so that no signal is applied to the other counter, and upon resetting of the first counter into the second reset counter condition, so that the resulting change in the output signal of the first counter causes a counting process to be effected in the other counter.

In accordance with an advantageous development of the present invention, the two reset counter positions are the output counter position of the first counter. There results hereby on the one hand the advantage of a particularly uncomplicated switching technique; on the other hand there results hereby the advantage that with the two partial ranges being equally large, a forward or backward setting of the time-measuring device is possible which corresponds at a maximum with the duration of one part range.

In accordance with another advantageous development of the present invention, the second reset counter position is a counter position preferably lying directly in front of the first counter position of the second partial range, within the first partial range. Particularly quick forward setting of the time-measuring device can thus be achieved in an advantageous way. If, e.g., the second partial range is placed at the end of the counting-range of the first counter so that the first partial range occupies nearly the whole counting-range of this counter, the time-measuring device is by the successive relatively quickly succeeding transition from the first partial range into the second partial range and back again into the first partial range and so on, relatively quickly set forward; on the other hand in that case nearly the whole counting-range of the first counter is available for resetting the counting device.

In accordance with yet another advantageous development of the invention, the first counter is connected by one single output to a count-input to the other or second counter. A simplification of switching circuitry hereby results in respect to the connection of the two counters.

In accordance with yet another advantageous development of the present invention, the first counter is connected on the output side to the count-input of the other counter via a decoder-circuit which in certain counter positions of the first counter emits the defined first output signal and in the remaining counter positions of the first counter in question emits a defined second output signal. This measure confers the advantage of simplifying the first counter, as will be made more obvious below.

In accordance with yet another advantageous development of the invention, for time-measurement of seconds, the first counter is used as a seconds-counter and further is divided up into two part-counters, one of which as unit-seconds part-counter has a count-capacity of 10 and counts on at seconds tempo controlled by the generator circuit and the other of which as ten-seconds part-counter has a count-capacity of 6 and each time at transition of the unit-seconds part-counter from the counter position 9 into the counter position O arrives in a new counter position. Additionally, for the time-measurement of minutes, the other or second counter is formed as a minutes-counter divided into two part-counters of which the part-counter controlled by the seconds-counter has a unit-minutes part-counter a count-capacity of 10 and the second part-counter has as ten-minutes part-counter a count-capacity of 6. The counters may in each case be constructed from impulse trailing edge controlled D-flipflops, which in each case may be reversible by the trailing edge of a pulse fed to their T-inputs. This materially simplified connections between the individual flipflops, as will become more obvious below.

In accordance with yet another advantageous development of the invention the reset inputs of the whole of the flipflops of the seconds-counter are connected together to a control device. This control device may be formed as a single switch, which upon actuation, emits a reset-signal. This confers the advantage of a particularly simple connection of the seconds-counter to the control device.

In one embodiment of the present invention the control device is formed of a series of switches which may be actuated in different combinations for the control of different setting or stopping processes respectively of the time-measuring device, together with a succeeding decoder, which at the output thereof merely emits reset-signal upon a certain combination of actuation of the switches in question. The advantage results herefrom of a particularly favorable multiple use of the switches which have to be provided for other setting or stopping processes of the time-measuring device.

Furthermore, a monostable sweep circuit may be connected after the decoder on the output side thereof. Thus, it is hereby possible in a particularly simple way to make available pulses or signals respectively which are defined with respect to time for setting the time-measuring device backward or forward.

DESCRIPTION OF FIGURES

The invention is illustrated as to particular preferred embodiments in the accompanying drawings, wherein.

DESCRIPTION OF PREFERRED EMBODIMENTS

Figure 1:
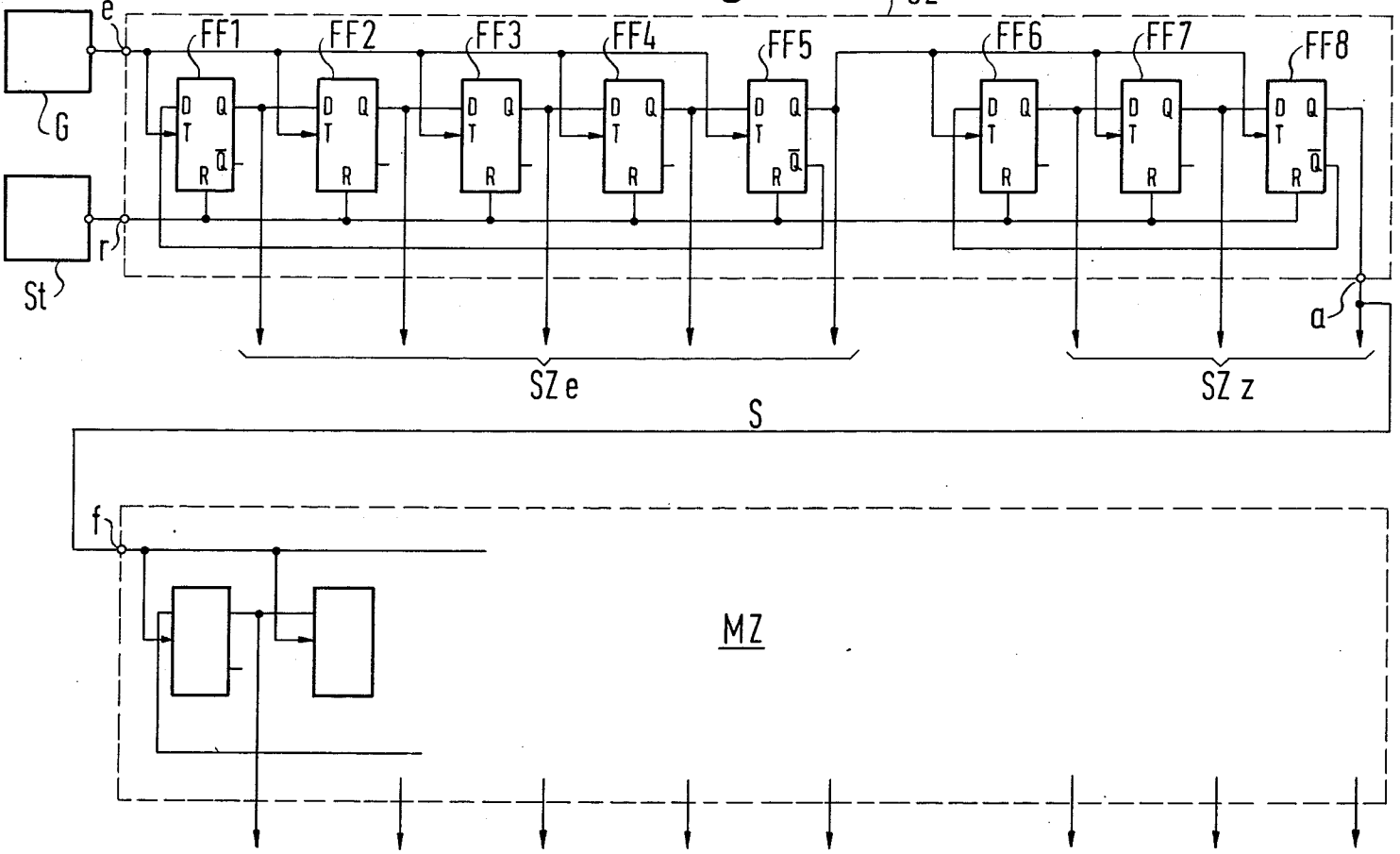
FIG. 1 is a circuit diagram of a first embodiment of a time-measuring device in accordance with the invention, and including at least two counters.

The switching arrangement illustrated in FIG. 1 of a time-measuring device in accordance with the present invention contains two counters SZ and MZ connected one after the other in series, with the first counter SZ connected by an input *e* as its count input to a generator circuit G which may be, e.g., a crystal-controlled impulse generator or oscillator and which in the present case may, for example, emit an output pulse every second. The generator G may include frequency divider circuits to produce output pulses at the desired rate. The counter SZ is also connected by an input *r* to a control device which is further described below. The counter SZ is counter MZ; and this input *f* is the count input to the counter MZ.

The counter SZ, having its input *e* connected to the generator circuit G, serves in the present case as a seconds-counter which, at the rate or tempo of the count-pulses emitted by the generator circuit, performs a counting process each second. The seconds-counter SZ is, in the illustrated embodiment, divided into two part-counters SZ*e* and SZ*z*. The first part-counter SZ*e* serves as unit-seconds part-counter; it counts the unit seconds, which means that every second it switches forward to another counter-position. The other part-counter SZ*z* serves as ten-seconds part-counter; this part-counter switches forward every 10 seconds into a new counter-position. The unit-seconds part-counter SZ*e* has a count-capacity of 10, and the ten-seconds part-counter SZ*z* has a count-capacity of 6. In order to achieve these count-capacities the unit-seconds part-counter SZ*e* in the present case comprises five flipflops FF1 to FF5 connected one after the other, and the ten-seconds part-counter SZ*z* comprises three flipflops FF6 to FF8. These flipflops may in this case be formed by impulse trailing edge controlled D-flipflops which means that they are controlled only by the trailing edge of a signal fed into their T-(time)-inputs, into the state which is determined by the signal present at the D-input in each case. The T-inputs of the flipflops FF1 to FF5 belonging to the unit-seconds part-counter SZ*e* are all connected together to the input *e* of the seconds-couonter SZ. The Q-output of each flipflop FF1 to FF4, carrying a "1"-signal in the set state, is connected with that input of the succeeding flipflop, which has to carry a 1-signal when at the occurrence of a signal at its T-input the latter flipflop is likewise to be set in the 1-state. The $\overline{Q}$-output of the last flipflop FF5 which thus in the reset state of this flipflop carries a 1-signal, is connected to the D-input of the first flipflop FF1. The unit-seconds part-counter SZ*e* so far described is therefore constructed after the style of a so-called Mobius counter. To the Q-output of the last flipflop FF5 of the unit-seconds part-counter SZ*e* are connected the T-inputs of the flipflops FF6, FF7 and FF8 forming the ten-seconds part-counter SZ*z*. The flipflops FF6, FF7, FF8 are in other respects connected together in a similar way to that which has been explained above with respect to the flipflops FF1 to FF5. Hence the ten-seconds part-counter SZ*z* is also constructed in the manner of a Mobius counter.

The R-(Reset)-inputs of all of the flipflops FF1 to FF8 of the seconds-counter SZ are connected to the input *r* to this counter and hence to the control device St.

The Q-outputs of the flipflops FF1 to FF8 of the seconds-counter SZ may be connected to seconds-indicator devices, and this is indicated in FIG. 1 merely by leads extending from the Q-outputs of the said flipflops FF1 to FF8. The indicator devices in question may provide for separate units and tens seconds-values being indicated.

Because of the described form of the seconds-counter SZ, the unit seconds part-counter SZ*e* thereof has a count-capacity of 10 and the ten-seconds part-counter SZ*z* has a count-capacity of 6. Thus the count-capacity is here in each case twice as large as the number of flipflops forming the respective part-counters.

The minutes counter MZ connected by its input or count-input *f* to the output *a* from the seconds-counter SZ may be constructed in the same way as the seconds-counter SZ described above. For the sake of simplicity this is not shown in detail in FIG. 1. Furthermore and likewise without this being shown in FIG. 1, at least one further counter for counting, e.g., hours can be connected beyond the minutes-counter. Again, indicator devices may be connected to the minutes-counter MZ as well as to the further counters provided as the case may be.

The construction of the circuit arrangement shown in FIG. 1 having been explained above, the method of operation of this circuit arrangement is now explained in some detail.

First, consider the operation of the unit-seconds part-counter. Starting from the reset state in which the whole of the flipflops FF1 to FF5 of the unit-seconds part-counter SZ*e* are reset, so that the Q-outputs of the flipflops FF1 to FF5 carrying in each case a "0"-signal, the flipflop FF1 is set by the appearance of the first count-pulse from the generator circuit G, and thereby emits at the Q-output thereof a 1-signal. The next count-pulse received from the generator circuit G causes the flipflop FF2 to be set in addition. This process is repeated in the same way until finally all five flipflops FF1 to FF5 of the unit-seconds part-counter SZ*e* are set. This is the state of the circuit SZ*e* when the fifth count-pulse has been received from the generator circuit G. Upon the occurrence of the next count-pulse from the generator circuit G the flipflop FF1 is reset again. The flipflop FF2 is then reset by the occurrence of the subsequent count-pulse from the generator circuit G. This process continues in the same way until finally the whole of the flipflops FF1 to FF5 are reset. This is the case when — starting from the output state being considered — ten count-pulses have been emitted by the generator circuit G.

The flipflops FF6, FF7 and FF8 of the ten-seconds part-counter SZ*z* are controlled in like manner by the output signal emitted from the Q-output of the flipflop FF5. Since it may be in the case of these flipflops just as in the case of the flipflops being considered above, be a matter of impulse trailing edge controlled D-flipflops, a counting process occurs in the ten-seconds part-counter only when the flipflop 5 is reset from its set state into its reset state. This is — starting from an output state in which the whole of the flipflops FF1 to FF5 are first of all in the reset state — the case after emission of every ten count-pulses by the generator circuit G. Hence from the Q-output of the flipflop FF8 of the ten-seconds part-counter SZ*z* a 1-signal is emitted only after — starting from the output state mentioned — thirty count-pulses have been emitted to the seconds-counter SZ. During the occurrence of the next thirty count-pulse from the generator circuit G there occurs again at the Q-output of the flipflop FF8 and hence at the output *a* of the seconds-counter SZ a 1-signal. Only at the fading of the last of these count-pulses does the flipflop FF8 arrive in its reset state in which an 0-output-signal again appears at its Q-output. Thus the counting-range of the seconds-counter SZ — if the signal appearing at the output *a* is considered — is thereby divided up into two partial ranges of equal size; in the first partial range there appears at the output *a* an 0 signal and in the second partial range there appears at the output *a* a 1-signal.

The minutes-counter MZ, which in like manner be constructed of so-called impulse trailing edge controlled D-flipflops, proceeds from one counter position into the next-counter position with the appearance of the trailing edge of the 1-output-signal emitted from the Q-output of the flipflop FF8. Expressed in other words this means that the minutes counter MZ performs a counting process when in the leads connecting the output *a* of the seconds-counter SZ to the input *f* of the minutes-counter MZ, transition occurs from a 1-signal to an 0-signal.

If a reset signal is now fed from the control device S*t* to the R-(Reset)-inputs of the flipflops FF1 to FF8 of the seconds counter SZ, e.g., a 1-signal, this causes the seconds-counter to return to the output position in which all of the flipflops FF1 to FF8 emit at their Q-outputs a 0-signal. If in such case the seconds-counter is in the first partial range of its counting-range — that is, the range from 0 to 30 seconds — nothing changes in that case at the Q-output of the flipflop FF8; and Q-output emits as before an 0-signal. But if the seconds-counter is at the point of time of its resetting in the second partial range of its counting-range — that is, the range from 31 to 60 seconds — there occurs at the Q-output of the flipflop FF8, and hence at the output *a* of the seconds-counter SZ, a transition from a 1-signal to an 0-signal, that is, in the same way as in the case of a normal counting process after receipt has occurred of a 60th count-pulse from the generator circuit G — starting from the output position of the seconds-counter SZ. The said transition, as already mentioned, therefore immediately leads to the minutes counter MZ being moved forward by one counter position. This feature is used in the present case for setting the time-measuring device comprising at least the two counters SZ and MZ under consideration, either forward or backward.

Resetting of the seconds-counter SZ out of a counter position lying in the first partial range into a reset counter position likewise lying in this partial range — that is in this case the starting counter position — is made use of by the control device for setting the time-measuring device backward. Thus at the point of time in question any count-signal or pulse is prevented from being fed to the minutes-counter. On the other hand resetting of the seconds-counter SZ out of a counter position lying in the second partial range into a second reset counter position likewise lying in the first partial range — that is also in this case the starting counter position — is made use of for setting the time-measuring device forward. That is to say, a count-signal or pulse is fed earlier to the minutes counter relative to the normal counting rhythm. Since the two partial ranges of the counting-range of the seconds-counter SZ are in this case of equal size, thus having a length of 30 seconds each, this means that it is possible by the control device S*t* to set the time-measuring device forward or backward exactly to seconds, in that by one control process at a time, that is, the emission of one output signal from the control device S*t*, a maximum of one forward setting or backward setting of the time-measuring device by 30 seconds can be performed. By repeated emission of an output signal from the control device S*t* at appropriate points in time, longer forward or backward setting times can be achieved.

In order to accomplish forward or backward setting of the time-measuring device with two switches marked or otherwise denominated "forward" and "backward", it is possible to connect the output *a* of the seconds-counter SZ to one input of an AND-element having two inputs and to the blocking input of a blocking element having this blocking input and a signal input. A switch used for setting the time-measuring device forward is connected to act upon the other input to the AND-element with a 1-signal. A switch used for setting the time-measuring device backward is connected to act upon the signal input to the blocking element with a 1-signal. Connection is made from the output of the AND-element and the output of the blocking element together to the R-inputs of all of the flipflops FF1 to FF8 of the seconds-counter SZ.

Figure 2:
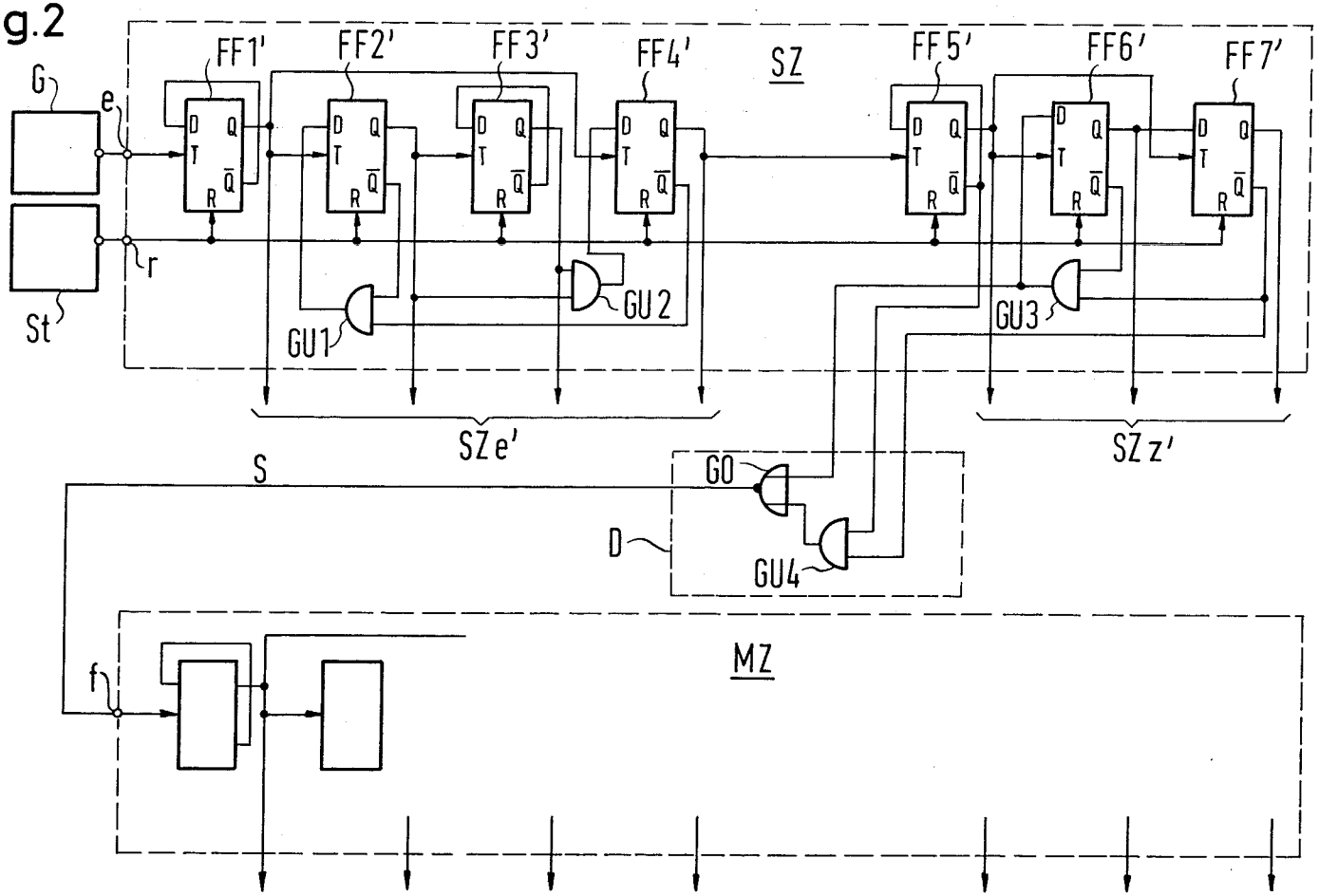
FIG. 2 is a circuit diagram of a second embodiment of a time-measuring device in accordance with the invention, and including at least two counters.

Another embodiment of the present invention illustrated in FIG. 2 corresponds in large part to the switching arrangement shown in FIG. 1 and like units thereof are similarly identified. There are provided in accordance with the embodiment of FIG. 2 a seconds-counter SZ connected to a generator circuit G and a control device S*t*, and a minutes-counter MZ, which may be constructed in like manner to the seconds-counter. Indicator-devices may be connected to the counters. Unlike the switching arrangement shown in FIG. 1, the seconds-counter SZ (and as the case may be, also he minutes counter) has in this case a rather different construction and moreover the seconds-counter SZ is not connected directly to the minutes-counter MZ but instead a decoder-circuit D couples the seconds and minutes counters. The unit-seconds part-counter SZ*e'* of FIG. 2 consists of only four matching impulse trailing edge controlled D-flipflops FF1' to FF4' to thus reduce the required number of flipflop circuits by one compared to the embodiment of FIG. 1. These flipflops FF1' to FF4' are connected together partly directly and partly via two AND-elements GU1 and GU2 in such a way that the unit-seconds part-counter SZ*e'* formed by them can adopt altogether ten different counter positions. At transition from the counter position 9 into the counter position O the flipflop FF4' emits from the Q-output thereof a signal at which the ten-seconds part-counter SZ*z'* connected beyond the unit-seconds part-counter SZ*e'* counts forward by 1. The ten-seconds part-counter SZ*z* ' which has a count-capacity of 6 is formed here by the flipflops FF5', FF6' and FF7' which are connected together as shown in FIG. 2, another AND-element GU3 being provided in the present case. The AND-circuit GU3 has the inputs thereof connected to the $\overline{Q}$-outputs of flipflops FF6' and FF7' and the output connected to the D-input of flipflop FF6'.

The decoder-circuit D noted above consists of an AND-element GU4 having the two inputs thereof connected to the Q-outputs of the flipflops FF5' and FF7'. Moreover the decoder-circuit D contains a NOR-element GO which has one of the inputs thereof connected to the output from the AND-element GU4 and the other input thereof connected to the output from the AND-element GU3 forming a part of the ten-seconds part-counter SZ*z'*. In the lead S connected to the count input *f* to the minutes counter MZ and to the output from the NOR-element Go there occurs as in the case of the switching arrangement shown in FIG. 1 a 1-signal only when the seconds-counter SZ is in counter positions corresponding with a second partial range of its counting-range. If the seconds-counter SZ is in counter positions corresponding with a first partial range of its counting range the lead S carried an 0-signal. Since at the count input *f* to the minutes-counter MZ, signals from the seconds-counter SZ occur in the same way as in the case of the switching arrangement shown in FIG. 1, at resetting the seconds-counter SZ the same processes occur in the minutes-counter MZ and in counters which if necessary follow after it. Consequently no further description of operation appears to be necessary.

Figure 3:
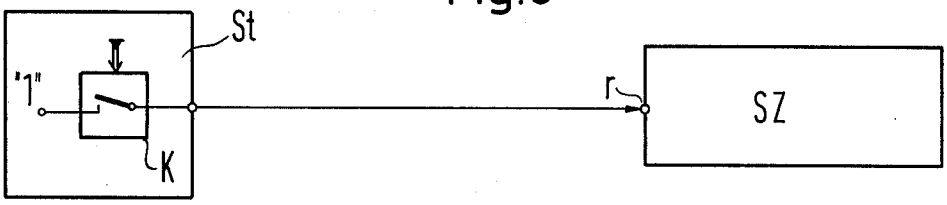
FIG. 3 schematically illustrates a first embodiment of a control device for a time-measuring device in accordance with the invention.

In FIG. 3 there is shown one possible embodiment of the control device S*t* employed in the switching circuitry of FIGS. 1 and 2. In accordance with FIG. 3 this control device S*t* contains a single switch K which by its actuation allows a logic 1-signal to be applied to the input *r* of the seconds-counter SZ. The switch K may in particular be a pushbutton switch.

Figure 4:
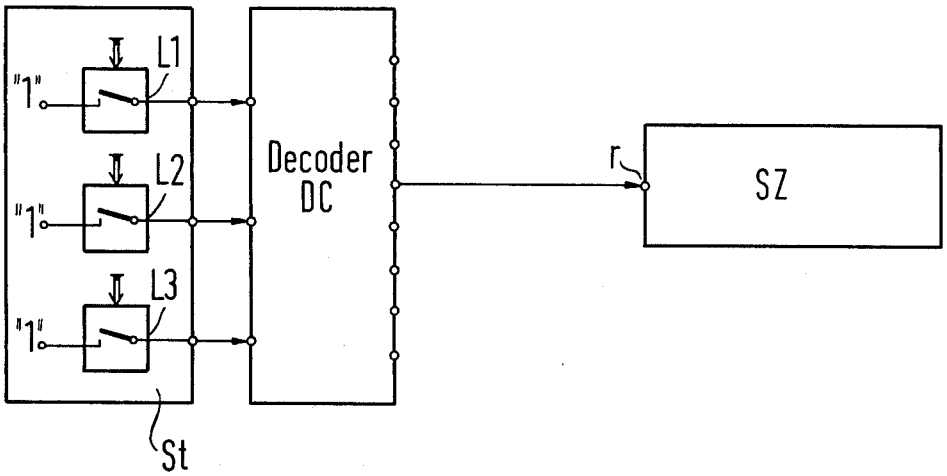
FIG. 4 schematically illustrates another embodiment of a control device for a time-measuring device in accordance with the invention.

In FIG. 4 there is shown another embodiment of the control device S*t* employed with the switching arrangements as FIGS. 1 and 2. This control device S*t* contains three separate switches L1, L2, L3 which by their actuation allow each a 1-signal to be passed therethrough. The switchpaths of the switches L1, L2, L3 are connected to the inputs of a decoder DC which depends upon the combination of 1-signals at its inputs may emit a logic 1-signal at its outputs. Various combinations of inputs may be provided for in the decoder. The input *r* to the seconds-counter SZ is connected to a particular output of the decoder DC. Other devices of the time-measuring device may be connected to the remaining outputs of the decoder DC. Thus, for example, a 1-signal occurring at another output from the decoder DC may be employed to reset the whole of the counters contained in the time-measuring device into a definite position. It is, however, also possible to make use of the 1-signals occurring at other outputs from the decoder DC for specific influencing of the counter position of certain of the counters in the time-measuring device. By combined actuation of the switches L1, L2 and L3 which likewise may be pushbutton switches, a plurality of functions may therefore be controlled in the time-measuring device. This is particularly of use when the whole switching arrangement is employed, for example, in a wrist watch the indicator device of which is made use of, for example, to alternatively indicate minutes and hours or seconds or days of the month respectively. This means that by means of the control device S*t* an indicator device already provided may also be made use of for multiple indication.

Figure 5:
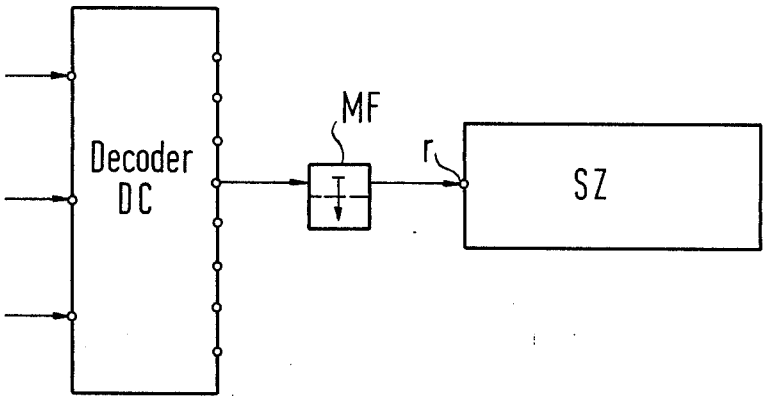
FIG. 5 illustrates a possible modification of the control device of FIG. 4.

In FIG. 5 there is shown a modification of the arrangement illustrated in FIG. 4. In accordance with FIG. 5 a monostable sweep circuit MF is inserted between the output from the decoder DC, and the input *r* of the seconds-counter SZ. This sweep circuit MF is triggered upon feeding an output signal from the relevant output from the decoder DC and changes for a predetermined period into an unstable state thereof in which it emits an output signal of definite duration to the input *r* to the seconds-counter SZ. The duration of the reset signal hereby becomes independent of the period of actuation of the switch.

It conclusion it should further be observed that the invention has been explained above with the aid of a time-measuring device which measures and if necessary indicates merely seconds and minutes. In this case the invention is of particular use, that is, in comparison with the settings or adjustments respectively hitherto performed with time-measuring devices. It is however also readily possible to apply the prinicples which have been explained, to time-measuring devices which measure and if necessary indicate, e.g., minutes and hours. It is likewise possible to apply the invention to time-measuring devices which allow more than two different time units to be measured.

What is claimed is:

1. A switching arrangement for setting or respectively adjusting a time-measuring device comprising at least two counters connected one after the other, of which a first counter changes counter position by count-pulses emitted by a generator circuit at successive intervals of time and the second counter receives a signal from the first counter upon transition of the first counter from one defined counter position into another defined counter position to cause an onward count of the second counter, and a control device for resetting the first counter, characterized in that the counting-range of the first counter is divided into two partial ranges of preferably at least approximately equal size, in one of which the first counter emits a defined first output signal and in the other of which the first counter emits a defined second output signal, and the control device being connected for resetting of the first counter out of a counter position lying in the first partial range into a first reset counter position lying in this first partial range for setting the time measuring device backward and resetting of the said first counter out of a counter position lying in the second partial range into a second reset counter position likewise lying in the first partial range for setting the time-measuring device forward.

2. A switching arrangement as in claim 1, characterized in that the two reset counter positions are the output counter position of said first counter.

3. A switching arrangement as in claim 1, characterized in that the second reset counter position is a counter position lying preferably directly in front of the first counter position of the second partial range, within the first partial range.

4. A switching arrangement as in claim 1, characterized in that said first counter is connected by a single output to a count-input of said second counter.

5. A switching arrangement as in claim 1, characterized in that said first counter is coupled on the output side to the count-input of said second counter by a decoder-circuit which in certain counter positions of said first counter emits a first output signal and in the remaining counter positions of said first counter emits a second output signal.

6. A switching arrangement as in claim 1, characterized in that for time-measurement of seconds said first counter is employed as seconds-counter and is divided up into two part-counters, one of which as unit-seconds part-counter has a count-capacity of 10 and counts on at seconds tempo controlled by said generator circuit and the other of which as ten-seconds part-counter has a count-capacity of 6 and at transition of the unit-seconds part-counter from the counter position 9 into the counter position O assumes a new counter position.

7. A switching arrangement as in claim 6, further characterized in that for the additional time-measurement of minutes said second counter comprises a minutes-counter divided up into two part-counters of which the part-counter controller by the seconds-counter has as unit-minutes part-counter a count-capacity of 10 and the second part-counter has as ten-minutes part-counter a count-capacity of 6.

8. A switching arrangement as in claim 6, characterized in that the counters are in each case comprised of impulse trailing edge controlled D-flipflops.

9. A switching arrangement as in claim 8, characterized in that said D-flipflops are reversible by the trailing edge of a pulse fed to the T-inputs thereof.

10. A switching arrangement as in claim 8, characterized in that the reset inputs of all of the D-flipflops of the seconds-counter are connected together to the control device.

11. A switching arrangement as in claim 1, characterized in that the control device is formed by a single switch which upon its actuation emits a reset-signal.

12. A switching arrangement as in claim 1, characterized in that the control device is formed as a series of switches which are operable in different combinations to produce signals for the control of different setting or stopping processes respectively of the time-measuring device, together with a decoder connected to the output of the control device emitting a reset-signal for a certain combination of actuation of the switches of the control device.

13. A switching arrangement as in claim 12, characterized in that a monostable sweep circuit is connected between the output of the decoder and the first counter.

14. A method of setting a time-measuring device having first and second counters connected in series with the first counter changing counter condition by times pulses from a generator circuit and the second counter changing counter condition by change of the first counter position from a first defined counter condition to another defined counter condition and control means for resetting the first counter, comprising the steps of dividing the count range of the first counter into two substantially equal parts and producing a first output signal for counts in the first part of the range and a second output signal for counts in the second part of the range and resetting the first counter by the control means in the first range back to zero count and in the second range to the equivalent of full count whereby the time-measuring device is automatically set upon actuation of the control means to the nearest mark in time.

* * * * *